US007726326B2

(12) United States Patent
O'Donnell et al.

(10) Patent No.: US 7,726,326 B2
(45) Date of Patent: Jun. 1, 2010

(54) UMBRELLA WITH REPOSITIONABLE GRIP

(75) Inventors: Daniel J. O'Donnell, Orlando, FL (US); Paul A. Crabb, 2405 Homewood Dr., Orlando, FL (US) 32809

(73) Assignees: Paul A. Crabb, Orlando, FL (US); Stingr Solutions, LLC, Orlando, FL (US)

( * ) Notice: Subject to any disclaimer, the term of this patent is extended or adjusted under 35 U.S.C. 154(b) by 0 days.

(21) Appl. No.: 12/275,863

(22) Filed: Nov. 21, 2008

(65) Prior Publication Data

US 2009/0178699 A1 Jul. 16, 2009

Related U.S. Application Data

(60) Provisional application No. 61/021,428, filed on Jan. 16, 2008.

(51) Int. Cl.
*A45B 9/02* (2006.01)
*A45B 25/08* (2006.01)

(52) U.S. Cl. ..... 135/25.4; 135/16; 135/44

(58) Field of Classification Search ..... 135/15.1, 135/16, 19, 25.33, 25.4, 28, 38–39, 43; 16/411, 16/413, 426, 436; 473/457, 568; 248/188.8, 248/188.9, 187.1; 396/419, 429, 433
See application file for complete search history.

(56) References Cited

U.S. PATENT DOCUMENTS 1,006,531 A * 10/1911 Carroll ..... 135/25.31
1,380,213 A 5/1921 Ralph
1,600,046 A 9/1926 Jackson
2,164,242 A 6/1939 Henry
2,220,900 A 11/1940 Halstead
2,443,772 A 6/1948 Levison
2,875,772 A 3/1959 Florence
3,030,837 A * 4/1962 Chartier ..... 72/457
3,245,421 A 4/1966 Hermina et al.
3,575,186 A 4/1971 Seitel
3,811,455 A 5/1974 Thur
4,229,015 A * 10/1980 Ramsey et al. ..... 280/819
4,456,023 A 6/1984 Fujihashi
D289,945 S 5/1987 Orenstein (Continued)

FOREIGN PATENT DOCUMENTS

DE 202 17 479 U1 1/2003

(Continued)

*Primary Examiner*—Winnie Yip
(74) *Attorney, Agent, or Firm*—Enrique Mora, Esq.; Beusse, Wolter, Sanks, Mora & Maire, P.A.

(57) ABSTRACT

Improved gripping structures for a hand-held umbrella are provided. In one example structure, a first grip is fixedly attached to an end of a shaft of the umbrella, such as the end located distally away from a canopy of the umbrella. A second grip is coupled to the shaft. The second grip may be slidably repositionable along the shaft. The second grip may include an interlocking device to lock the second grip at a desired location along the shaft. The second grip may further include a runner interface. An accessory mount may be disposed at the first grip to couple an accessory, such as a camera, at the end of the shaft distally away from the canopy of the umbrella.

25 Claims, 5 Drawing Sheets

U.S. PATENT DOCUMENTS

| | | | | |
|---|---|---|---|---|
| 5,080,118 | A | 1/1992 | Allen | |
| D327,166 | S | 6/1992 | Barker | |
| 5,186,197 | A | 2/1993 | Lavine | |
| D336,981 | S | 7/1993 | Smith | |
| 5,297,571 | A * | 3/1994 | Chu et al. | 135/24 |
| 5,337,771 | A | 8/1994 | Berges et al. | |
| 5,577,722 | A * | 11/1996 | Glassberg | 473/457 |
| 5,910,105 | A * | 6/1999 | Swain et al. | 600/131 |
| 6,006,771 | A * | 12/1999 | Wu | 135/41 |
| 6,039,062 | A * | 3/2000 | Karakaedos | 135/16 |
| 6,334,454 | B1 | 1/2002 | Williams | |
| 6,367,125 | B1 * | 4/2002 | Lin | 16/436 |
| 6,409,611 | B1 * | 6/2002 | Louk, Jr. | 473/286 |
| D466,684 | S | 12/2002 | Van Dam | |
| 6,510,861 | B1 * | 1/2003 | Mead | 135/16 |
| D496,782 | S | 10/2004 | Miles | |
| D554,358 | S | 11/2007 | Buchanan | |
| D554,359 | S | 11/2007 | Buchanan | |
| 7,350,530 | B2 | 4/2008 | Lisciandro et al. | |
| 2005/0022459 | A1 | 2/2005 | Chang | |
| 2006/0081276 | A1 * | 4/2006 | Tung | 135/16 |
| 2008/0163910 | A1 | 7/2008 | Hollinger | |
| 2008/0163911 | A1 | 7/2008 | Lisciandro et al. | |

FOREIGN PATENT DOCUMENTS

| | | | |
|---|---|---|---|
| JP | 03063003 | A * | 3/1991 |
| JP | 08322621 | A * | 12/1996 |
| JP | 2002078517 | A * | 3/2002 |
| JP | 2004209014 | A * | 7/2004 |
| WO | WO 01/08526 | A | 2/2001 |
| WO | WO 03/097186 | A1 * | 11/2003 |

* cited by examiner

UMBRELLA WITH REPOSITIONABLE GRIP

This application claims the benefit of U.S. provisional patent application No. 61/021,428, filed on Jan. 16, 2008, which application is herein incorporated by reference in its entirety.

FIELD OF THE INVENTION

The present invention is generally related to umbrellas, and, more particularly, to an umbrella grip structure conducive to holding a hand-held umbrella in a manner that can adaptively accommodate user preferences and/or varying operational conditions while providing ergonomic benefits to the user.

BACKGROUND OF THE INVENTION

Known hand-held umbrella designs have not appropriately addressed various considerations that can significantly affect the comfort and convenience of the user, and/or affect the operational performance of the umbrella, particularly in connection with umbrellas that may have a canopy encompassing a relatively large surface area and/or a relatively long shaft and thus may result in relatively large forces when subjected to wind.

For example, known umbrella designs tend to exhibit a generally rigid approach to how the user holds the umbrella. One example of the rigid approach of such umbrella designs is that a handle fixed at a singular position is provided to indiscriminately fit all users, regardless of individual user preferences and/or variable operational conditions. Further, umbrella handles are commonly affixed to the end of the shaft furthest from the umbrella canopy, and this is not necessarily the best position when considering comfort, convenience and performance under a variety of weather and operational conditions. Accordingly, it is desirable to provide practical and cost-effective structural improvements that can readily and in a user-friendly manner accommodate individual user preferences while providing ergonomic benefits to the user, such as grip positional adaptability under various operational circumstances, such as light rain versus heavy rain, light wind versus heavy wind, or even when holding other objects in addition to the umbrella.

BRIEF DESCRIPTION OF THE DRAWINGS

Aspects of the invention are explained in the following description in view of the drawings that show.

DETAILED DESCRIPTION OF THE INVENTION

Figure 1:
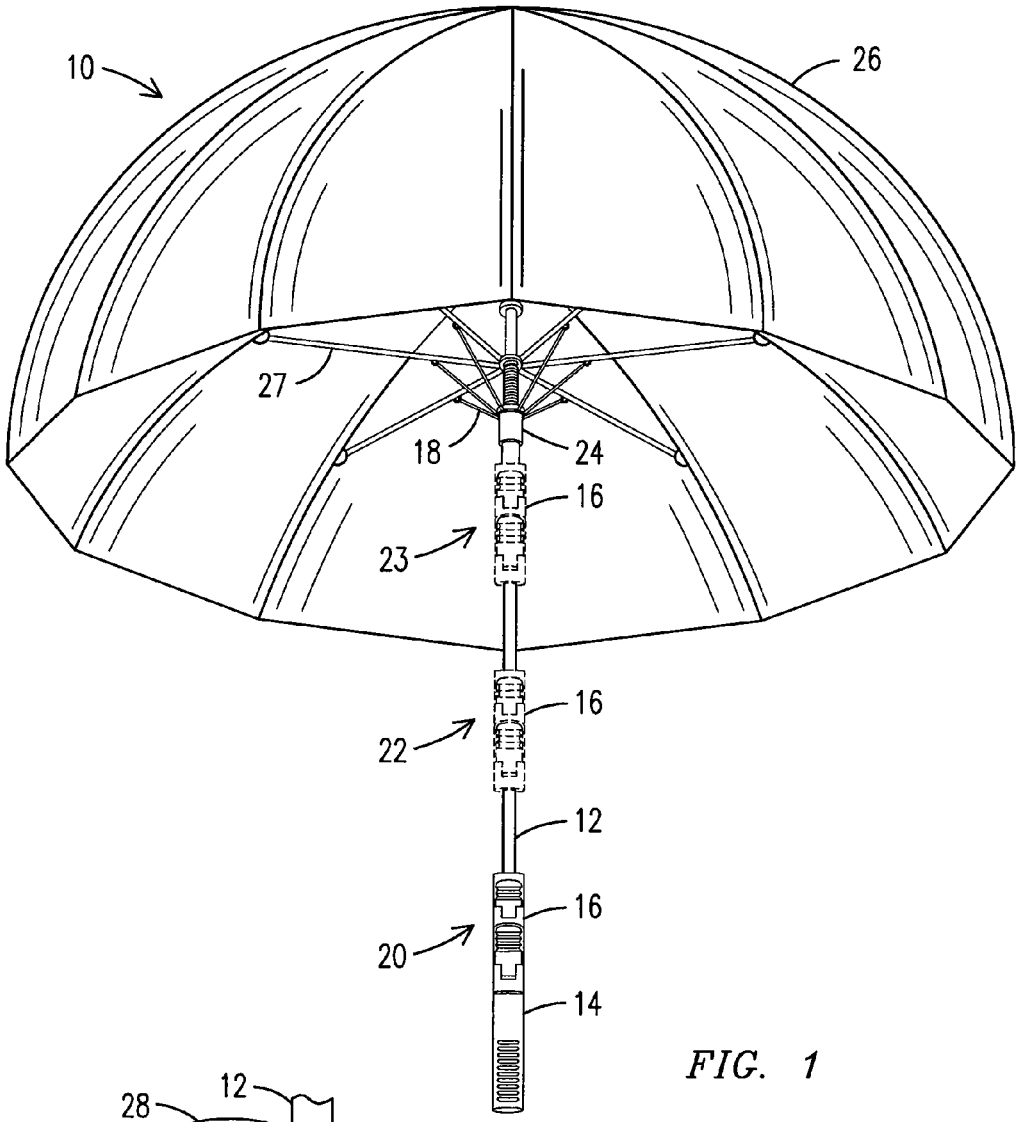
FIG. 1 is a schematic representation of an umbrella embodying aspects of the present invention, such as a first grip fixedly mounted at one end of the shaft and a repositionable second grip.

Aspects of the present invention are directed to various improvements in connection with a hand-held umbrella. FIG. 1 illustrates a schematic representation of an umbrella 10 embodying aspects of the present invention. The umbrella has a shaft 12 that in one example embodiment includes a first grip 14 (e.g., fixedly mounted at the end of the shaft located distally away from a canopy 26 of the umbrella) and a repositionable second grip 16 mounted on the shaft 12 between the first grip 14 and a runner 24. As shown in FIG. 1, the second grip 16 can be slidably repositioned and then locked anywhere along the shaft 12 between the first grip and the runner to improve a user's ability to securely and comfortably hold the umbrella under a variety of operational and/or environmental conditions. It will be appreciated that the second grip 16 may be repositionable to a new location along the shaft while the umbrella is an open condition. It will be appreciated that the shaft of the umbrella need not be a single-piece shaft design since aspects of the present invention may be applicable to a telescopic shaft arrangement, such as a shaft arrangement where two or more shafts slide within one another but do not necessarily collapse inside the other to provide an overall reduction in shaft length.

By way of illustration, FIG. 1 illustrates a first example position 20 where the second grip 16 is positioned proximate to the first grip 14. FIG. 1 further illustrates a second example position 22 where the second grip 16 is positioned generally intermediate between the first grip 14 and runner 24. A third example position 23 is shown where the second grip 16 may be positioned proximate to the runner 24. As will be appreciated by those skilled in the art, the canopy 26 (in both auto-open umbrellas as well as manual-open umbrellas) is traditionally opened and closed by movement of the runner along the shaft to directly affect the open/close state of the umbrella through interaction of a stretcher assembly 18 and a canopy-rib assembly 27.

Generally, an umbrella user has to contend with various forces, such as a moment of force produced by the canopy when subjected to wind. For example, the magnitude of the moment of force is proportional to a moment arm, e.g., a distance from the canopy to the handle of the umbrella, which may be located several feet from the canopy. The inventors of the present invention have advantageously recognized that a repositionable grip (e.g., grip 16) that can be selectively repositioned along the shaft 12 will substantially reduce the length of the moment arm, and thus will reduce the magnitude of a counterforce needed to stabilize the umbrella. Another example of a force that an umbrella user deals with is exerting a sufficient gripping force to maintain control of the umbrella. A reduction of the magnitude of the gripping force is ergonomically desirable to reduce strain on the hand and/or arm of the user holding the umbrella.

It is estimated that a repositionable grip embodying aspects of the present invention can reduce the magnitude of the counter force needed to control the umbrella in a range from approximately 15% to approximately 70%, compared with the force that would be needed with a traditional handle fixed at the end of the shaft of the umbrella. For example, the lower end of the range may be expected when the repositionable grip 16 is positioned near the first grip 14. Conversely, the upper end of the range may be expected when the repositionable grip 16 is positioned near the canopy 26. The example range above represents the counter force exerted by the hand-arm combination to stabilize the umbrella and does not factor the gripping force exerted by the hand.

In one example embodiment, the repositionable grip 16 may be a factory-installed part of a given umbrella's design, and may be installed during the manufacture of the umbrella. For example, the structure of the repositionable grip may define an axially-extending bore (not shown) through which an end of the shaft is inserted at a suitable stage of the manufacturing process of the umbrella.

Figure 2:
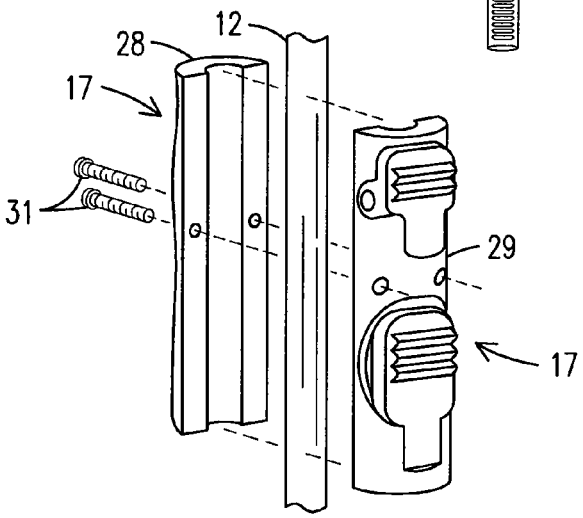
FIG. 2 is a schematic representation of a repositionable grip, which may be assembled as an add-on accessory to an existing umbrella by a user.

In another example embodiment the repositionable grip may be an add-on accessory to an already-fabricated umbrella, as such accessory may be attached by a consumer. For example, the repositionable grip may be constructed using a clam-shell type of design or other suitable design that enables it to be attached without disassembling components of the existing umbrella. For example, as shown in FIG. 2, a repositionable grip 17 may be made up of two connectable pieces 28 and 29 that may be assembled on the shaft 12 by any suitable affixing means 31, e.g., clamps, bolts, screws, hinges.

It will be appreciated that the grip shape illustrated in the figures should be construed in an example sense and not in a limiting sense since the repositionable grip can have a variety of shapes (e.g., cylindrical, pistol grip, contour grip) and can be made from a variety of materials (e.g., foam, hard rubber, gel, plastic, wood). The shaft-receiving surface of the repositionable grip may be designed so that the umbrella shaft is not affected (e.g., marred) by the slidable movement of the grip up and down the shaft, or by the mechanism used to secure the grip to the shaft.

Figure 3:
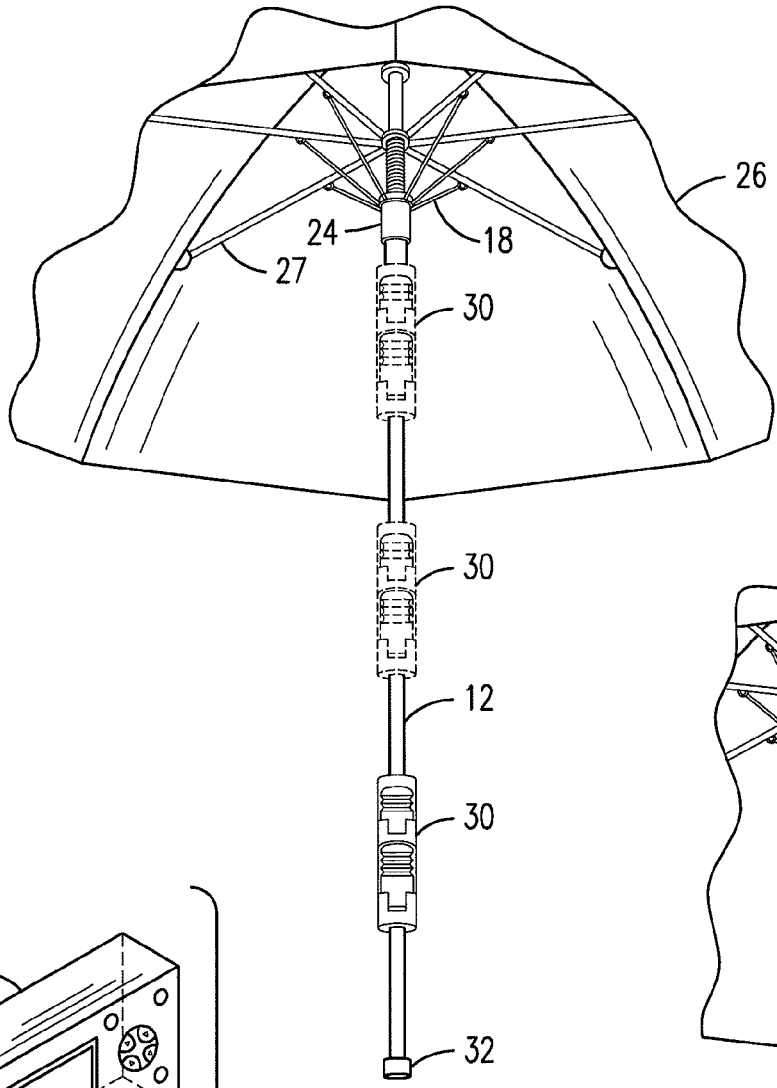
FIG. 3 is a schematic representation of an umbrella embodying additional aspects of the present invention, such as a unitary repositionable grip.

In another example embodiment, as shown in FIG. 3, it is contemplated that, in lieu of a repositionable second grip, one may design the umbrella to include a unitary repositionable grip 30 that can be selectively positioned along the shaft 12 of the umbrella to reach any number of distinct positions between a grip stop 32 and the runner 24, as similarly described above. The unitary grip is repositionable along the shaft while the umbrella is an open condition. FIG. 3 shows three distinct example positions for the unitary grip 30.

Figure 4:
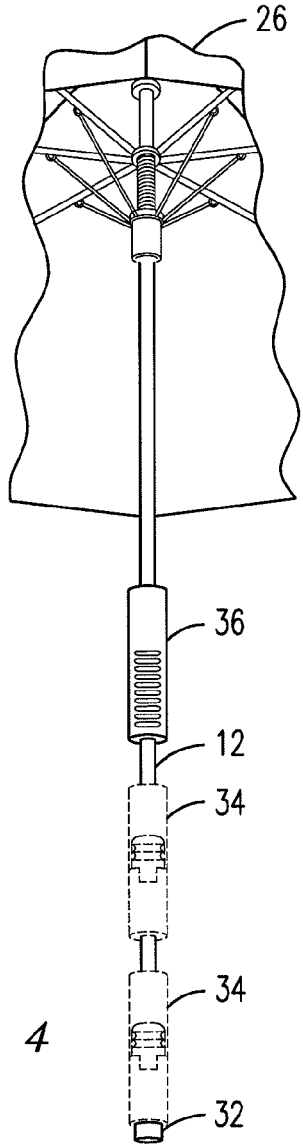
FIG. 4 is a schematic representation of an umbrella embodying yet additional aspects of the present invention, such as a repositionable first grip mounted on the shaft and a second grip fixedly attached to an intermediate location on the shaft.

In yet another example embodiment, as shown in FIG. 4, it is contemplated that a first grip 34 may be slidably repositionable along a portion of the shaft 12. The first grip 34 may be repositionable along a portion of the shaft while the umbrella is an open condition. A second grip 36 may be fixedly attached to the shaft at a generally intermediate shaft location. For example, the repositionable grip 34 may be selectively repositioned between grip stop 32 and the second grip 36.

Figure 5:
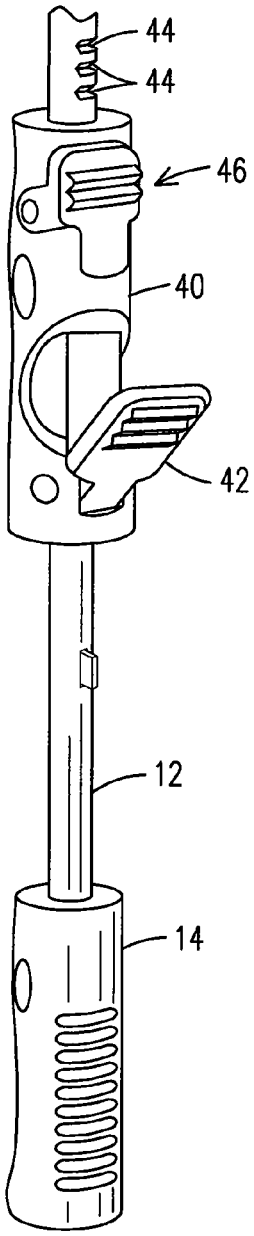
FIGS. 5 and 6 respective illustrate example structural details in connection with a repositionable grip embodying aspects of the present invention.
Figure 6:
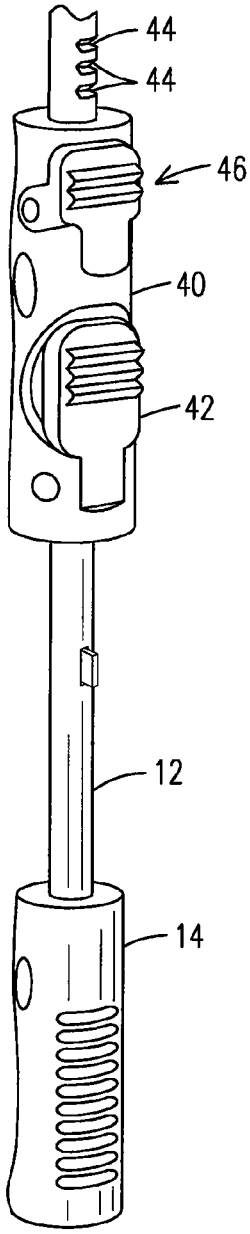

FIGS. 5 and 6 illustrate example structural details in connection with a repositionable grip 40 embodying further aspects of the present invention. The grip may include a suitable interlocking device 42 for selectively locking (e.g., reversible single-action locking or unlocking) the repositionable grip at a desired grip location along the shaft 12. Interlocking device 42 may use any of various locking structures. For example, a cam-lock interlocking device can provide lockable positions virtually anywhere along the shaft of the umbrella. In this example, a cam or protuberance 54 (seen in FIGS. 9 and 10) constructed in the inner surface of the interlocking device may be arranged to press against the shaft when the interlocking device is in a locked condition and not press against the shaft when the interlocking device is in an unlocked condition. In another example of the locking structure, the interlocking device 42 may cooperate with indents, weatherproof cutouts or slots (conceptually represented by shaft indents 44 in FIGS. 5 and 6) that may be constructed in the shaft to provide a number of discrete lockable positions for the repositionable grip.

FIG. 5 illustrates the interlocking device 42 set in an open condition (e.g., unlocked condition) that allows the repositionable grip to be moved to a desired gripping position. FIG. 6 illustrates the interlocking device 42 set in a closed condition (e.g., locked condition) that allows the repositionable grip to be locked at the desired gripping position. The repositionable grip 40 may further include a runner interface 46, described in greater detail below, which can be used to open and close the umbrella.

Figure 7:
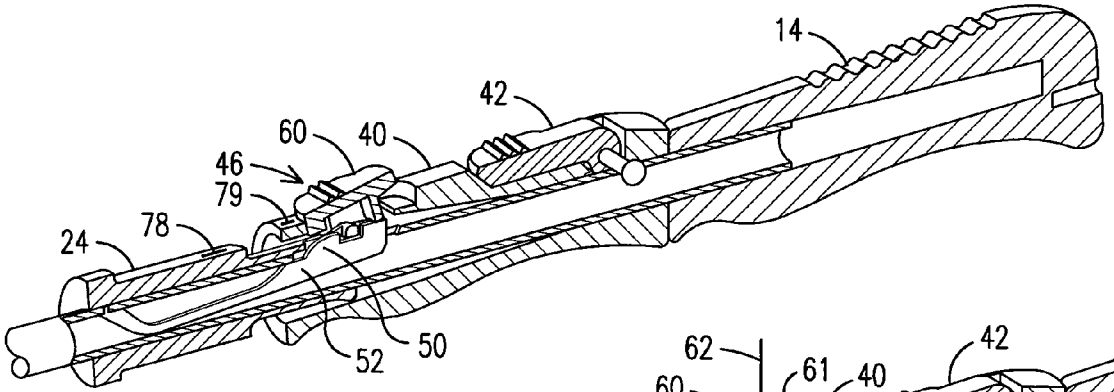
FIGS. 7 and 8 respectively illustrate cut-away views of a repositionable grip embodying aspects of the present invention, as may be used to manipulate a runner to open the umbrella.
Figure 8:
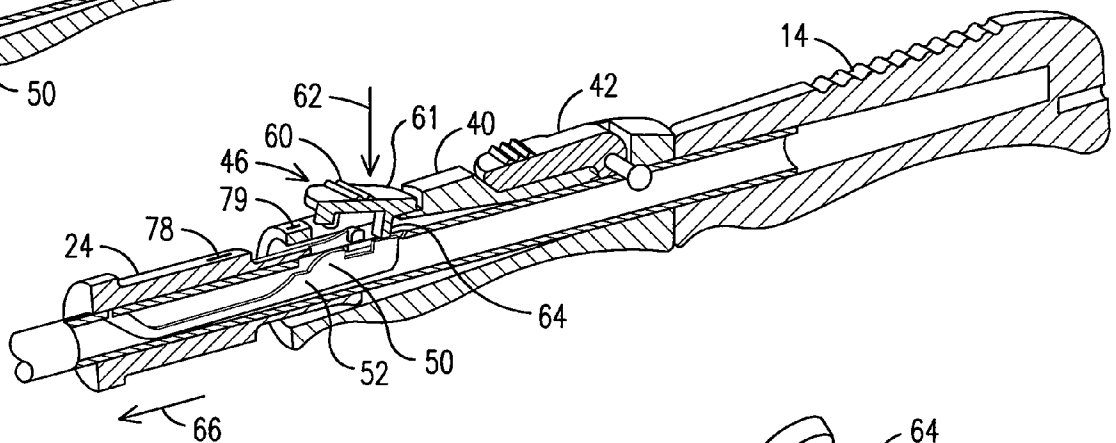

FIG. 7 illustrates a cut-away view of repositionable grip 40 in an example initial condition where the umbrella is in a closed condition. In one example umbrella design, a catcher 50 may be constructed in a runner release latch 52 (e.g., a bottom runner release) insertable in a retaining cutout (not shown) constructed in the runner 24.

As illustrated in FIG. 7, a first section 61 of a toggle button 60 in the runner interface 46 may be depressed by the user in a direction indicated by arrow 62 so that a first structure, such as a step 64 (see also FIG. 11) in the runner interface, is urged against the release latch 52 so that catcher 50 is lowered and is no longer retained by the cutout in the runner. This will permit movement of the runner 24 along the shaft 12 in a direction indicated by arrow 66 to bring the umbrella from a closed condition to an open condition. Accordingly, one may utilize the repositionable grip to open the umbrella. In a manual-open umbrella, the repositionable grip may be used to push the runner to an open position. Similarly, in an auto-open umbrella design, depressing toggle button 60 will cause the umbrella to automatically open as the release latch 52 is disengaged from the runner. Accordingly, it will be appreciated that runner interface 46 is not limited to any specific umbrella design since the structure of the runner interface can be modified to accommodate umbrella design variations. For example, the above-described toggle button design is readily implementable without any substantial involvement by the umbrella manufacturer. It is envisioned, however, that in lieu of a toggle button design, one could provide a spring-activated button arranged to engage the release latch through the runner cutout to release the runner. This optional approach would likely require collaborative design efforts between the umbrella manufacturer and STINGR Solutions LLC. One can further envision a spring-loaded ball in the shaft (in lieu of the current release latch) that could be released via a twisting, pressing or sliding action by a suitably modified runner interface mechanism.

Figures 9, 10:
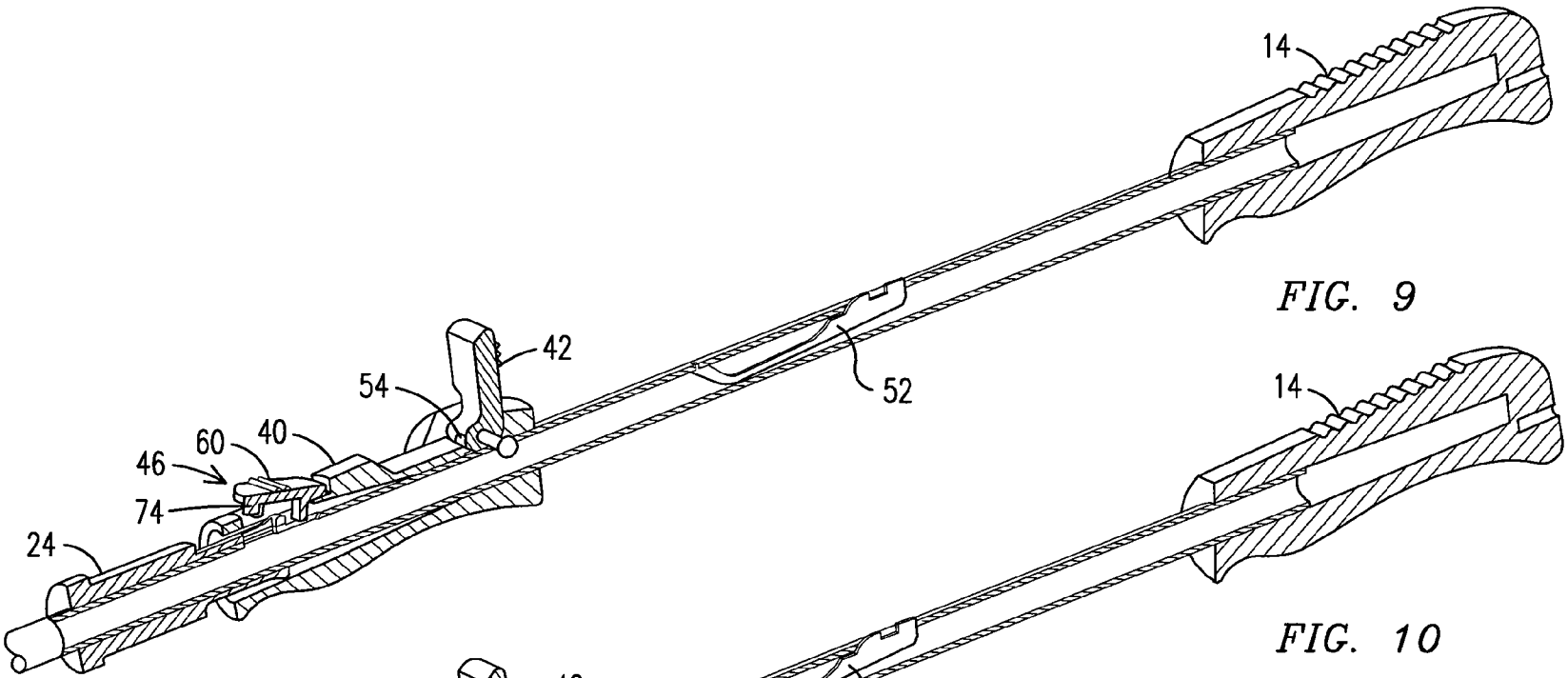
FIGS. 9 and 10 respectively illustrate cut-away views of the repositionable grip shown in FIGS. 7 and 8 as may be used to manipulate a runner to close the umbrella.

FIG. 9 illustrates a cut-away view of repositionable grip 40 corresponding to an example where the repositionable grip has just been moved (hence unlocked condition of interlocking device 42) to engage the runner 24 while the umbrella is in an open condition. In one example umbrella design, one may use the repositionable grip to release a second runner release latch (e.g., a top runner release, not shown) and bring the umbrella from an open condition to a closed condition. It will be appreciated that other example umbrella designs may not utilize a top release latch since, for example, the canopy may be held in an open condition under a spring-derived tension without the runner being retained by any latch mechanism. As suggested above, the runner interface 46 can be adapted to accommodate any such umbrella design variations.

As illustrated in FIG. 10, a second section 71 of the toggle button 60 in the runner interface 46 may be depressed by the user in a direction indicated by arrow 72 so that a second structure, such as one or more spaced apart teeth 74 (see also FIG. 11) in the runner interface grab a lip 73 (e.g., flared contour) in the runner 24. For example, in response to a pulling action by the user, this will enable movement of the runner 24 along the shaft 12 in a direction indicated by arrow 76 to bring the umbrella from the open condition to the closed condition. In one example embodiment, the toggle button may be held down by the user to maintain engagement with the runner as the repositionable grip is pulled down towards the first grip to close the umbrella. In another example embodiment, it is contemplated that after the repositionable grip is manually pushed up the shaft to engage the runner, the runner interface will automatically remain connected to the runner (e.g., by way of a spring-based interface mechanism, such as a spring-loaded pin or tooth that interfaces with a corresponding slot in the runner) without the user having to press the toggle button while the repositionable grip is being pulled toward the first grip to close the umbrella. It is further contemplated that the runner lip may be optionally replaced by a circumferential slot arranged to be engaged by the teeth of the runner interface.

As seen in FIG. 7, an alignment indicia 78 (e.g., a marking) may be optionally provided at an edge of the runner interface so that alignment with a corresponding indicia 79 on the runner facilitates placing the runner interface in a position conducive to establish runner disengagement from any retaining latch or the like. It will be appreciated by those skilled in the art that both the runner interface in the repositionable grip and the runner can be designed to preclude the need for rotational alignment of the repositionable grip and the runner.

Figure 11:
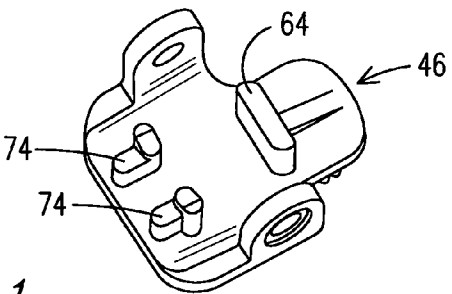
FIG. 11 is an isometric view of a runner interface as may be used in a repositionable grip embodying aspects of the present invention to open and close the umbrella.

FIG. 11 is an isometric view of a runner inter interface 46 as may be used in a repositionable grip embodying aspects of the present invention. FIG. 11 shows the step 64 and teeth 74 described above for actuating the runner to bring the umbrella to either an open condition or to a closed condition. It is envisioned that structural adaptations of the runner interface design may be used to accommodate for variations in umbrella runner latch and shaft designs without necessarily requiring modification by the umbrella manufacturer to a given umbrella design.

Example Advantages:

1. Provides added flexibility in securely holding an umbrella in a variety of adverse conditions and circumstances.

2. Improves ability of user to stabilize the umbrella in wind.

3. Improves ability for user to remain dry during driving rain.

4. Increases comfort by providing multiple positions for the grip.

5. Allows the user to easily reposition the grip while the umbrella remains open.

6. Enables user to use repositionable grip to rest the umbrella shaft on shoulder.

7. Makes it easier to open and close the umbrella.

8. Provides an anti-pinch feature when the repositionable grip is used to disengage the runner when closing or opening the umbrella.

9. Makes it easier to hold other items under the umbrella to keep them dry.

10. Allows the grip feature to be incorporated onto existing umbrella designs without requiring the umbrella manufacturer to make any changes to their existing design.

Figure 12:
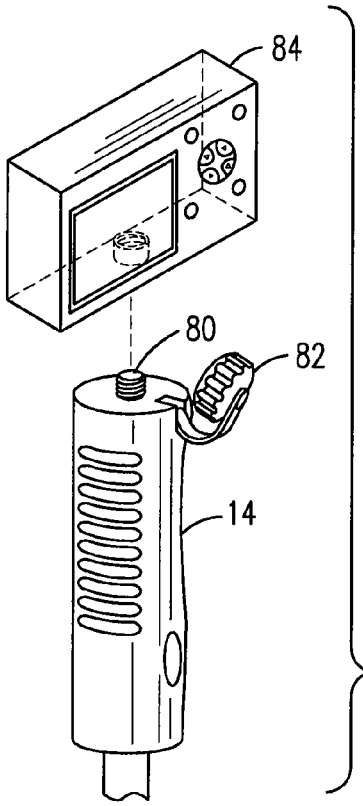
FIG. 12 is a schematic representation of an accessory-mounting arrangement, as may be disposed at an end of the shaft of the umbrella.

In addition to the repositionable grip concepts described above, it is contemplated that a primary umbrella grip, alone or in combination with a repositionable grip, may be further improved as shown in FIG. 12 by way of an accessory mount. For example, a coupling member 80 may be mechanically connected (e.g., via threads, expansion joint, pressure-fit or any suitable affixing means) to the first grip 14 (e.g., stationary grip) to couple (e.g., by way of a male-threaded coupler) an accessory at the one end of the shaft distally away from the canopy of the umbrella. It will be appreciated that in the example case of a unitary repositionable grip (or in the example case of a fixed intermediate grip in combination with a repositionable grip) then the coupling member 80 may be connected to grip stop 32 (FIGS. 3 and 4) at the one end of the shaft located distally away from the canopy of the umbrella.

Figure 13:
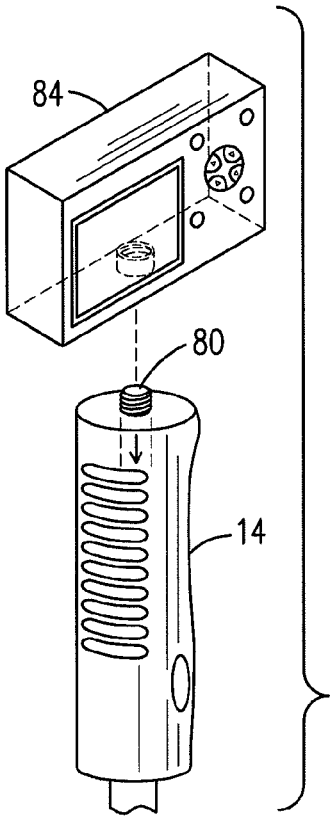
FIG. 13 shows a schematic representation of a retractable accessory-mounting arrangement.

In each example case, it will be appreciated that any of various accessories can be attached to this coupling member. The coupling member may be covered by a tethered lid 82 or other means when not being used. It is contemplated that the coupling member may be a retractable member (as schematically represented in FIG. 13) so that it remains hidden when not in use, thus avoiding use of a cover for the coupling member.

By way of example, a camera 84 (or video camera) can be mounted on the male-threaded coupler to receive a female threaded coupler disposed in the accessory. In one example application, this feature would allow interfacing the coupling member 80 to a standard female tripod mount feature of the camera, and the umbrella can be used (while in the closed position) as a monopole for stabilizing the camera during picture taking. The umbrella also provides a means to raise the camera over visual obstructions (e.g., crowds of people) for improved picture/movie taking. Additional example accessories that can be similarly attached may be a carry pack (e.g., for holding keys, camera, cell phone, sunglasses, etc.) or may be a safety light/flashlight, etc.

An example application of the improved gripping structures embodying aspects of the present invention may be for umbrellas having a relatively large and symmetrical canopy (e.g., 54-68 inch arc length) and/or relatively long shaft length (e.g., 36-43 inches), such as may be used by golfers, and/or as may be used for advertising logos. It will be understood that the improved gripping structures embodying aspects of the present invention are in no way limited to umbrellas having a relatively large symmetrical canopy since, for example, umbrellas having an asymmetrical canopy design may similarly benefit from the various advantages provided by aspects of the present invention.

From the foregoing disclosure, it will be appreciated that an umbrella design embodying aspects of the present invention may comprise any of the following features: structural and/or operational features directed to a second repositionable grip, structural and/or operational features directed to a unitary repositionable grip, or structural and/or operational features directed to both a second repositionable grip and a primary grip as described herein.

While various embodiments of the present invention have been shown and described herein, it will be understood that such embodiments are provided by way of example only. Numerous variations, changes and substitutions may be made without departing from the invention herein. For example, a combination of two repositionable grips may be realized depending on the needs of a given application. Accordingly, it is intended that the invention be limited only by the spirit and scope of the appended claims.

What is claimed is:

1. A hand-held umbrella comprising:

a shaft having a first end located proximate a canopy of the umbrella and a second end located distally away from the canopy;

a first grip fixedly attached to the second end of the shaft of the umbrella; and a second grip coupled to the shaft, wherein the second grip is repositionable along the shaft, wherein the second grip includes an interlocking device selectively actuated from an unlocked condition to a locked condition so that the second grip is locked at any one of a plurality of positions located between the ends of the shaft, wherein in the locked condition the interlocking device is arranged to press against the shaft and in the unlocked condition the shaft is not pressed by the interlocking device so that the second grip is repositionable between the ends of the shaft without affecting the shaft.

2. The umbrella of claim 1, wherein the second grip comprises a runner interface.

3. The umbrella of claim 2, wherein the runner interface comprises a first structure configured to selectively release a runner and permit movement of the runner along the shaft to bring the umbrella from a closed condition to the open condition.

4. The umbrella of claim 3, wherein the first structure comprises a step configured to actuate a latch in response to a manual action of a user so that the runner is freed from the latch.

5. The umbrella of claim 2, wherein the runner interface comprises a second structure configured to connect with the runner and in response to a pulling action by the user permit movement of the runner along the shaft to bring the umbrella from the open condition to a closed condition.

6. The umbrella of claim 5, wherein the second structure comprises at least one tooth configured to grab a lip of the runner.

7. The umbrella of claim 1, further comprising an accessory mount disposed at the first grip, wherein the accessory mount comprises a coupling member configured to operatively couple a photographic accessory at the end of the shaft distally away from the canopy of the umbrella.

8. The umbrella of claim 7, wherein the coupling member comprises a male threaded coupler configured to receive a female threaded coupler disposed in the accessory.

9. The umbrella of claim 7, wherein the coupling member comprises a retractable member.

10. The umbrella of claim 7, wherein the accessory mount further comprises a cover for covering the coupling member when not in use.

11. A hand-held umbrella comprising:

a shaft having a first end located proximate a canopy of the umbrella and a second end located distally away from the canopy;

a grip stop fixedly attached to the second end of the shaft of the umbrella; and a unitary grip coupled to the shaft, wherein the unitary grip is repositionable along the shaft, wherein the unitary grip includes an interlocking device selectively actuated from an unlocked condition to a locked condition so that the unitary grip is locked at any one of a plurality of positions located between the ends of the shaft, wherein in the locked condition the interlocking device is arranged to press against the shaft and in the unlocked condition the shaft is not pressed by the interlocking device so that the unitary grip is repositionable between the ends of the shaft without affecting the shaft.

12. The umbrella of claim 11, wherein the unitary grip comprises a runner interface.

13. The umbrella of claim 12, wherein the runner interface comprises a first structure configured to selectively release the runner and permit movement of the runner along the shaft to bring the umbrella from a closed condition to the open condition.

14. The umbrella of claim 13, wherein the first structure comprises a step configured to actuate a latch in response to a manual action of a user so that the runner is freed from the latch.

15. The umbrella of claim 12, wherein the runner interface comprises a second structure configured to connect with the runner and in response to a pulling action by the user permit movement of the runner along the shaft to bring the umbrella from the open condition to a closed condition.

16. The umbrella of claim 15, wherein the second structure comprises at least one tooth configured to grab a lip of the runner.

17. The umbrella of claim 11, further comprising an accessory mount disposed at the grip stop, wherein the accessory mount comprises a coupling member configured to operatively couple photographic accessory by said end of the shaft.

18. The umbrella of claim 17, wherein the coupling member comprises a male threaded coupler configured to receive a female threaded coupler disposed in the accessory.

19. The umbrella of claim 17, wherein the coupling member comprises a retractable member.

20. The umbrella of claim 17, wherein the accessory mount further comprises a cover for covering the coupling member when not in use.

21. A hand-held umbrella comprising:

a first grip coupled to a shaft of the umbrella, wherein the first grip is repositionable along a portion of the shaft;

a second grip fixedly attached to an intermediate location on the shaft; and a grip stop fixedly attached to an end of the shaft located distally away from a canopy of the umbrella, wherein the first grip includes an interlocking device selectively actuated from an unlocked condition to a locked condition so that the first grip is locked at any one of a plurality of positions located between the grip stop and the second grip, wherein in the locked condition the interlocking device is arranged to press against the shaft and in the unlocked condition the shaft is not pressed by the interlocking device so that the first grip is repositionable between the grip stop and the second grip without affecting the shaft.

22. The umbrella of claim 21, further comprising an accessory mount disposed at the grip stop, wherein the accessory mount comprises a coupling member configured to operatively couple a photographic accessory by said end of the shaft.

23. The umbrella of claim 22, wherein the coupling member comprises a male threaded coupler configured to receive a female threaded coupler disposed in the accessory.

24. The umbrella of claim 22, wherein the coupling member comprises a retractable member.

25. The umbrella of claim 22, wherein the accessory mount further comprises a cover for covering the coupling member when not in use.

* * * * *